US009644407B1

(12) United States Patent
Abramovits

(10) Patent No.: US 9,644,407 B1
(45) Date of Patent: May 9, 2017

(54) ADJUSTABLE DOOR WEDGE WITH A LOCKING MECHANISM

(71) Applicant: Alain Abramovits, Frisco, TX (US)

(72) Inventor: Alain Abramovits, Frisco, TX (US)

( * ) Notice: Subject to any disclaimer, the term of this patent is extended or adjusted under 35 U.S.C. 154(b) by 192 days.

(21) Appl. No.: 14/445,901

(22) Filed: Jul. 29, 2014

Related U.S. Application Data

(60) Provisional application No. 61/860,612, filed on Jul. 31, 2013.

(51) Int. Cl.
*E05C 17/54* (2006.01)

(52) U.S. Cl.
CPC ..... *E05C 17/54* (2013.01)

(58) Field of Classification Search
CPC . E05Y 2201/224; E05C 17/54; E05C 19/182; E05C 17/025; Y10T 292/73; Y10T 16/61; Y10T 292/71; Y10T 292/34; Y10T 16/27; E05F 5/06; Y10S 292/15; E05D 11/06
USPC ..... 292/343
See application file for complete search history.

(56) References Cited

U.S. PATENT DOCUMENTS

| | | | | |
|---|---|---|---|---|
| 4,501,444 | A | 2/1985 | Dominguez | |
| 5,465,460 | A * | 11/1995 | Cantone | E05C 17/50 16/82 |
| 6,161,252 | A * | 12/2000 | Rodriguez | E05C 17/52 16/82 |
| 2014/0312634 | A1* | 10/2014 | Cushwa, Jr. | E06B 5/10 292/340 |
| 2015/0240541 | A1* | 8/2015 | Tellarini | E05C 17/54 16/82 |

* cited by examiner

*Primary Examiner* — Mark Williams
(74) *Attorney, Agent, or Firm* — Schultz & Associates, P.C.

(57) ABSTRACT

A door wedge for securing a door in a stationary position and having a locking mechanism to prevent forward and backward movement of the door is provided. The door wedge includes a base member with an upper layer pivotably mounted to a lower layer, and a L-shaped member slidably mounted to an end of the lower layer. The upper layer and lower layer of the base member compress with respect to each other to enable the door to slide over the upper layer and decompress to secure the door within space between the upper layer and the L-shaped member, thereby preventing forward and backward movement of the door.

5 Claims, 6 Drawing Sheets

ADJUSTABLE DOOR WEDGE WITH A LOCKING MECHANISM

RELATED APPLICATION

The application claims priority to provisional patent application U.S. Ser. No. 61/860,612 filed on Jul. 31, 2013, the entire contents of which is herein incorporated by reference.

BACKGROUND

The embodiments herein relate generally to devices such as door wedges to prevent doors from closing.

Individuals use devices such as door wedges to secure a door in an open position. This eliminates the burden of a user exerting effort to push and/or hold open the door when entering a room. There exist a variety of single piece door wedges or collapsible devices such as U.S. Pat. No. 4,501,444, which are placed below the door to secure the door. However, these wedges and devices are limited because they only secure the door and prevent movement of the door in a single direction. The area surrounding a door is often exposed to pockets of air such as drafts. These drafts, if oriented in a particular direction, can push and release the door from the wedge or device, thereby causing the door to close completely. Further, current single piece door wedges are disadvantageous because they are made from materials that are subject to premature wear when in contact with the door. This renders the wedges impractical and/or unusable after several uses.

As such, there is a need in the industry for a durable door wedge with a locking mechanism that prevents both forward and backward movement of the door when in a secured position.

SUMMARY

A door wedge for securing a door in a stationary position and comprising a locking mechanism configured to prevent forward and backward movement of the door is provided. The door wedge comprises a base member comprising an upper layer and a lower layer configured to rest on a ground surface, the lower layer comprising a first end and a second end pivotably mounted to the upper layer; and a L-shaped member comprising a vertical member coupled to a horizontal member, wherein the horizontal member is slidably mounted to the first end of the lower layer, wherein the upper layer and lower layer of the base member are configured to compress with respect to each other to enable the door to slide over the upper layer and decompress to secure the door within space between the upper layer and the L-shaped member, thereby preventing forward and backward movement of the door.

In an alternative embodiment, the door wedge comprises a L-shaped member comprising a vertical member coupled to a horizontal member configured to rest on a ground surface, and an upper layer pivotably mounted to the horizontal member of the L-shaped member, wherein the upper layer and horizontal member are configured to compress with respect to each other to enable the door to slide over the upper layer and decompress to secure the door within space between the upper layer and the L-shaped member.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
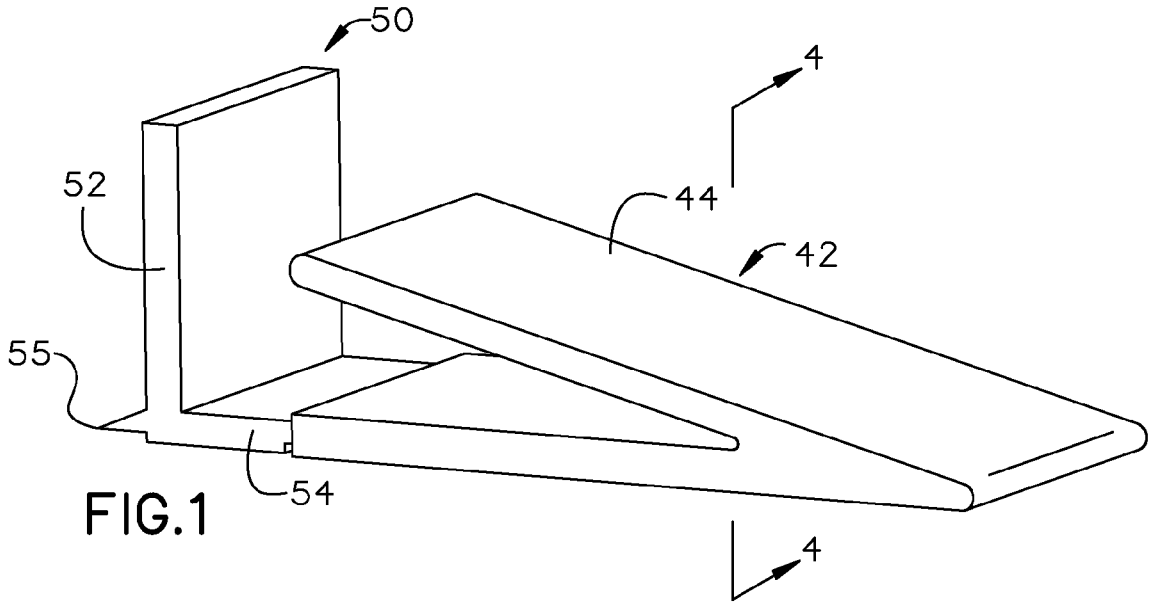
FIG. 1 depicts a perspective view of certain embodiments of the door wedge.
Figure 2:
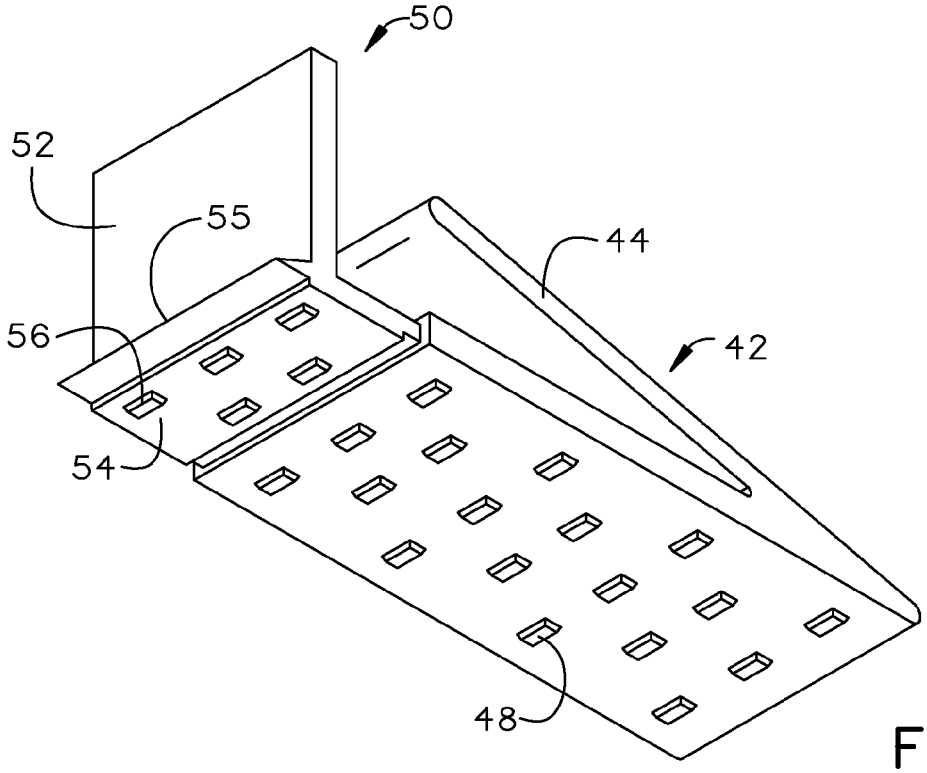
FIG. 2 depicts a lower perspective view of certain embodiments of the door wedge.
Figure 3:
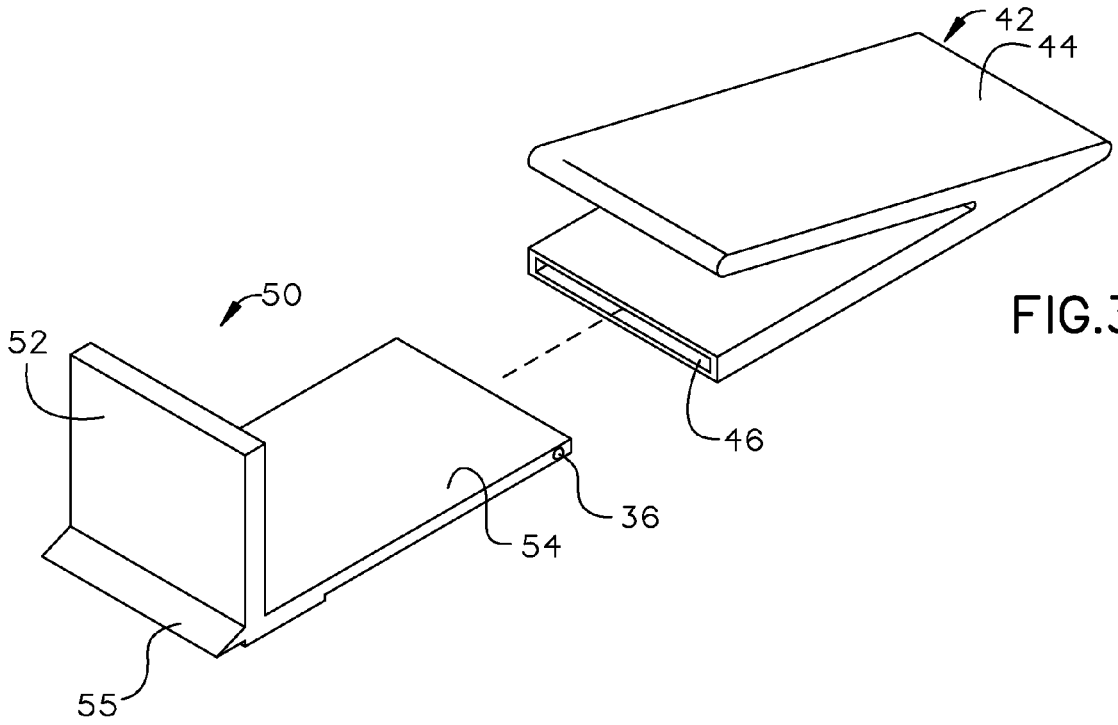
FIG. 3 depicts an exploded view of certain embodiments of the door wedge.

As depicted in FIGS. 1-3, the door wedge comprises base member 42 and L-shaped member 50. Base member 42 comprises upper flexing tongue 44 pivotably mounted to a lower layer, which comprises slot 46 disposed throughout an interior portion of the lower layer. L-shaped member 50 comprises vertical member 52, horizontal member 54, positioning nubs 36 and lip 55. Vertical member 52 and horizontal member 54 are coupled and offset from each other by approximately 90 degrees. However, an alternative degree offset may be used instead.

In one embodiment, teeth 48 are affixed to a bottom portion of the lower layer of base member 42. Similarly, teeth 56 are affixed to a bottom portion of horizontal member 54. Teeth 48 and teeth 56 are configured to contact a ground surface and provide additional traction to prevent movement of the door wedge when in use with a door. Teeth 48 and teeth 56 may be made from any type of material including, but not limited to, rubber, plastic, or the like. While FIG. 2 depicts teeth 48 and teeth 56 oriented in a parallel configuration, alternative configurations of the teeth may be used instead.

As depicted in FIG. 3, horizontal member 54 of L-shaped member 50 is inserted into slot 46 of base member 42. Horizontal member 54 is slidably adjusted to the interior walls of slot 46, which will be described in more detail with respect to FIGS. 7-10. In a preferred embodiment, base member 42 and L-shaped member 50 are both made from a durable and flexible material such as rubber. However, it is understood that alternative materials may be used instead.

Figure 4:
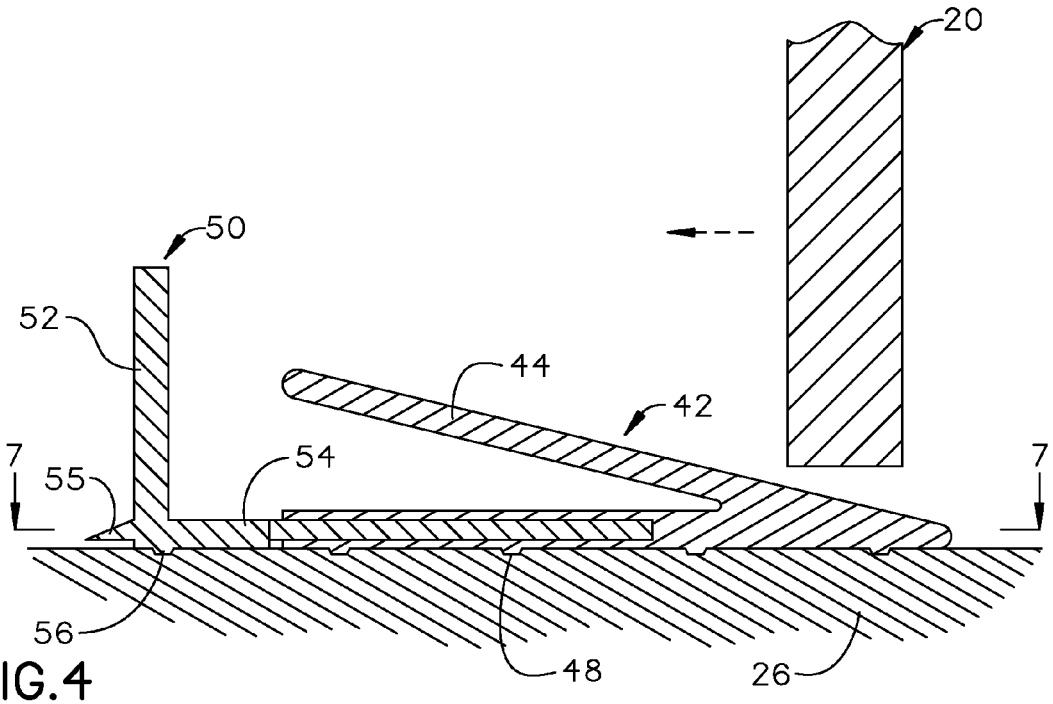
FIG. 4 depicts a section view of certain embodiments of the door wedge in use taken along line 4-4 in FIG. 1, prior to the door interfacing with the wedge.
Figure 5:
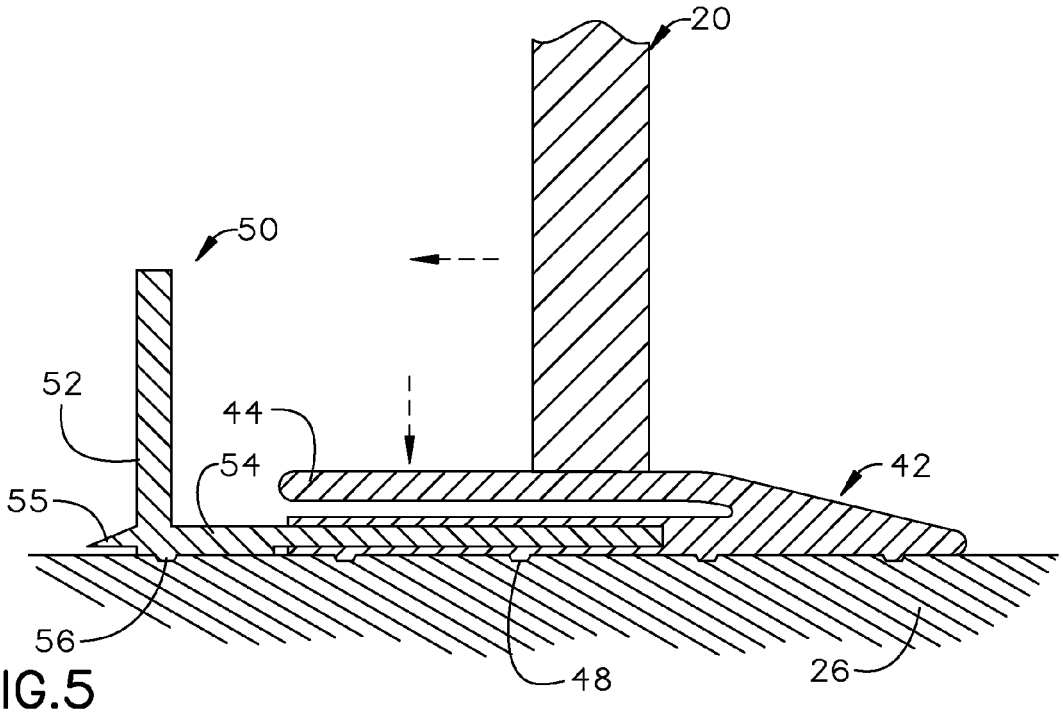
FIG. 5 depicts a section view of certain embodiments of the door wedge in use with the door interfaced with the wedge in an unsecured configuration.
Figure 6:
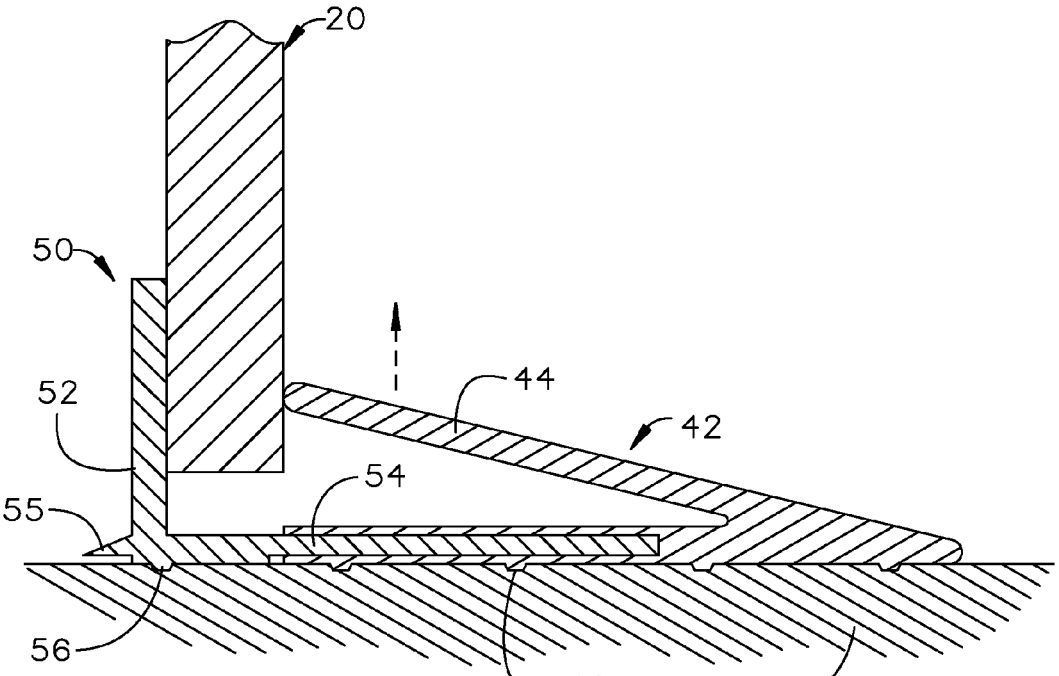
FIG. 6 depicts a section view of certain embodiments of the door wedge in use with the door interfaced with the wedge in a secured configuration.

As depicted in FIG. 4, the door wedge is positioned such that teeth 48 and teeth 56 both contact ground surface 26. Door 20 is directed towards base member 42. As depicted in FIG. 5, door 20 continues its movement and slides over upper flexing tongue 44. This causes upper flexing tongue 44 to compress with the lower layer of base member 42. During the time door 20 contacts upper flexing tongue 44, the door wedge may be inclined to tip over. However, lip 55 of L-shaped member 50 contacts ground surface 26 if this occurs, which maintains the bottom portions of base member 42 and L-shaped member 50 flush with ground surface 26. As depicted in FIG. 6, upper flexing tongue 44 decompresses to its resting position once door 20 slides past upper flexing tongue 44. This secures door 20 in a stationary position within the space between vertical member 52 and upper flexing tongue 44. In this secured configuration, forward and backward movement of the door is prevented. To release door 20 to an unsecured position, a downward force is applied to upper flexing tongue 44 to compress the tongue and lower layer of base member 42 together. This force can be applied to upper flexing tongue 44 by a user's foot or a tool such as a cane. This is advantageous because the user does not have to bend over to release door 20 from the locked position, which prevents the chance the user will suffer lower body and/or back injuries. Once upper flexing tongue 44 is sufficiently compressed, door 20 can slide back over the tongue and away from the door wedge.

Figure 7:
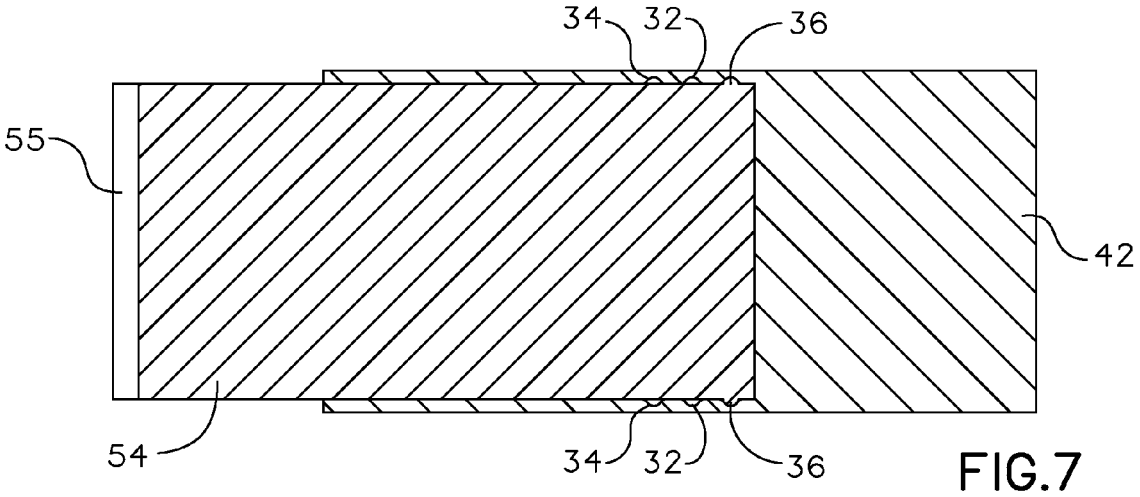
FIG. 7 depicts a section view of certain embodiments of the door wedge taken along line 7-7 in FIG. 4.
Figure 8:
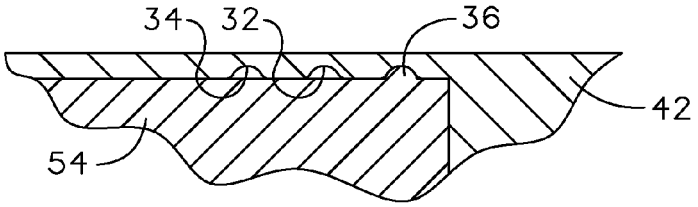
FIG. 8 depicts a section view of certain embodiments of the door wedge.
Figure 9:
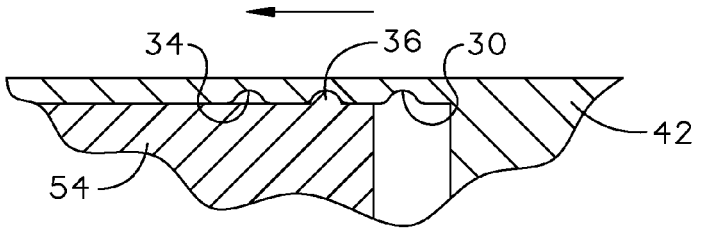
FIG. 9 depicts a section view of certain embodiments of the door wedge.
Figure 10:
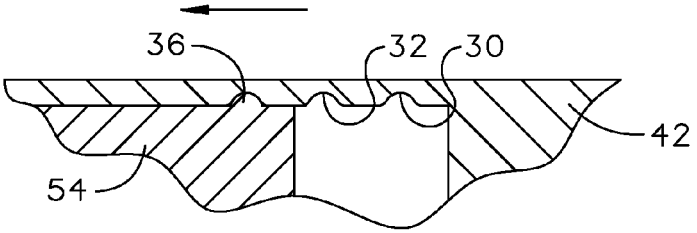
FIG. 10 depicts a section view of certain embodiments of the door wedge.

L-shaped member 50 and base member 42 may be slidably adjusted with respect to each other to increase or decrease the amount of space between vertical member 52 and upper flexing tongue 44. This allows the door wedge to accommodate a door having any sized thickness. As depicted in FIGS. 7-10, a positioning nub 36 is affixed to each side wall of horizontal member 54. The interior side walls of base member 42 in slot 46 comprise inner positioning grooves 30, middle positioning grooves 32 and outer positioning grooves 34. As such, a user can push or pull L-shaped member 50 such that positioning nubs 36 of horizontal member 54 slidably engage with inner positioning grooves 30, middle positioning grooves 32 or outer positioning grooves 34. In FIGS. 7-8, positioning nubs 36 are shown engaged with inner positioning grooves 30. In FIG. 9, positioning nub 36 is shown engaged with middle positioning groove 32. In FIG. 10, positioning nub 36 is shown engaged with outer positioning groove 34. It shall be appreciated that any alternative number of grooves and nubs may be used with the door wedge.

Figure 11:
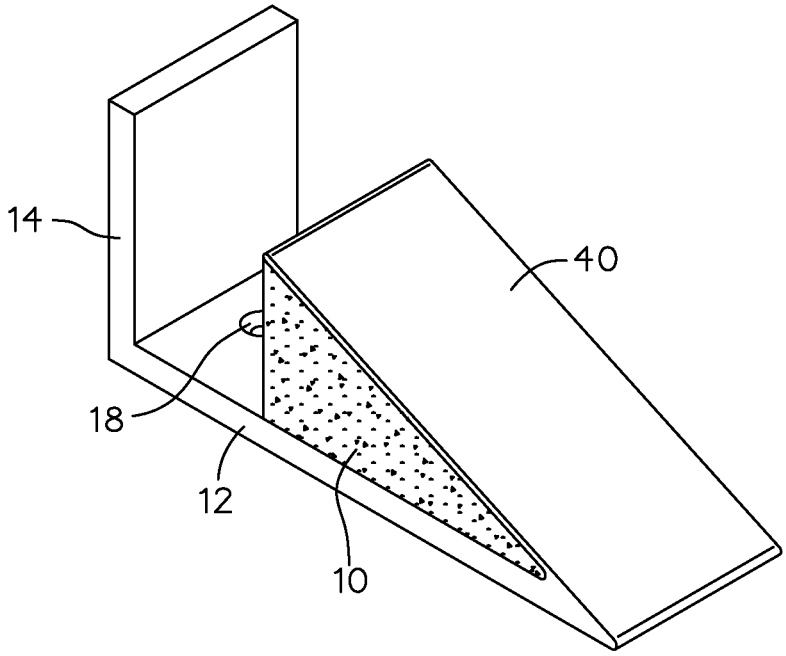
FIG. 11 depicts a perspective view of an alternative embodiment of the door wedge.

FIGS. 11-14 depict an alternative embodiment of the door wedge, which operates similarly to the embodiments described above. As depicted in FIG. 11, the alternative door wedge comprises an L-shaped member comprising vertical member 14 and horizontal member 12. Upper flexing tongue 40 is pivotably mounted to an end of horizontal member 12. Teeth 16 are affixed to a bottom portion of horizontal member 12. Foam member 10 is disposed between upper flexing tongue 40 and horizontal member 12. Foam member 10 compresses when door 20 slides over upper flexing tongue 40 and helps to return upper flexing tongue 40 to its resting uncompressed position once door 20 passes by. In a preferred embodiment, foam member 10 is a memory foam-type wedge. However, it is understood that any alternative component may be used instead of foam such as a spring. In an alternate embodiment, horizontal member 12 comprises an optional floor mount hole 18, which may receive a fastener such as a nail or screw to help secure the door wedge to ground surface 26.

Figure 12:
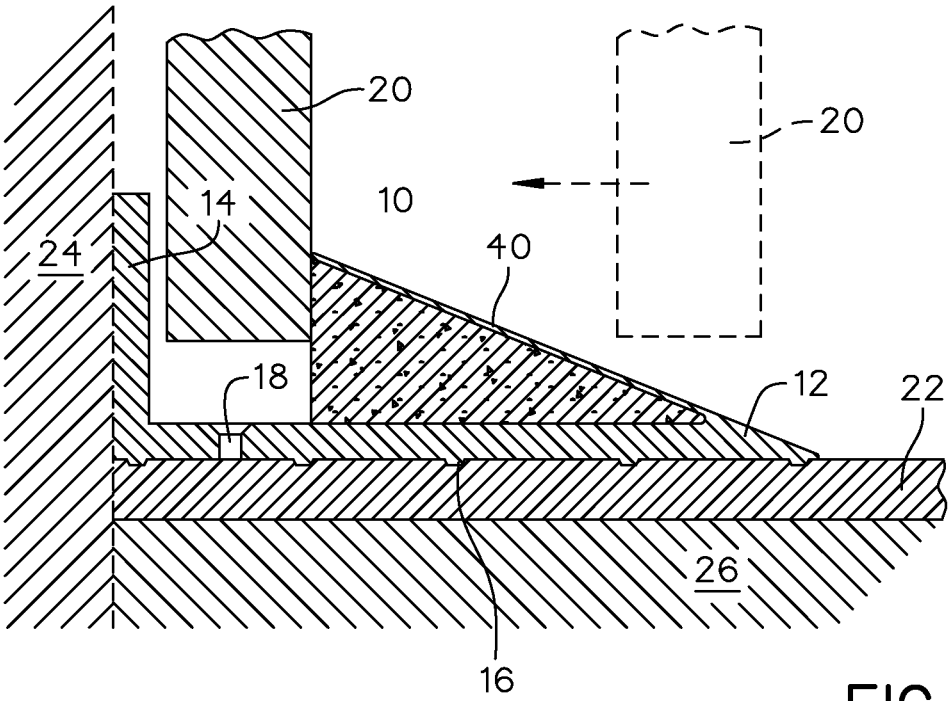
FIG. 12 depicts a side view of the alternative embodiment of the door wedge in use.
Figure 13:
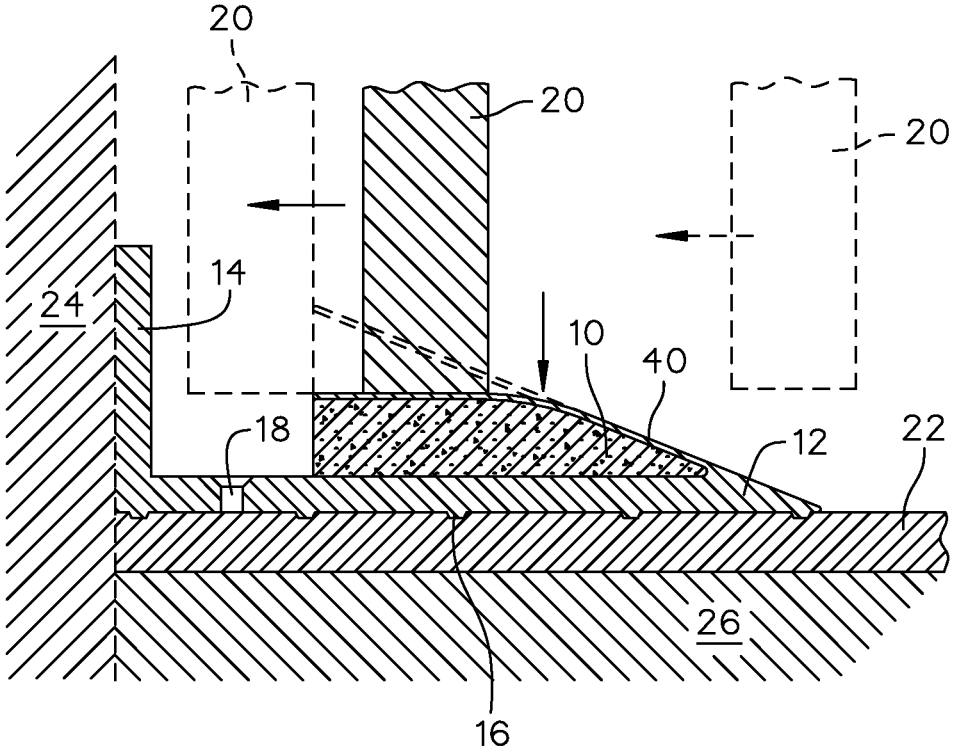
FIG. 13 depicts a side view of the alternative embodiment of the door wedge in use with the door interfaced with the wedge in an unsecured configuration.
Figure 14:
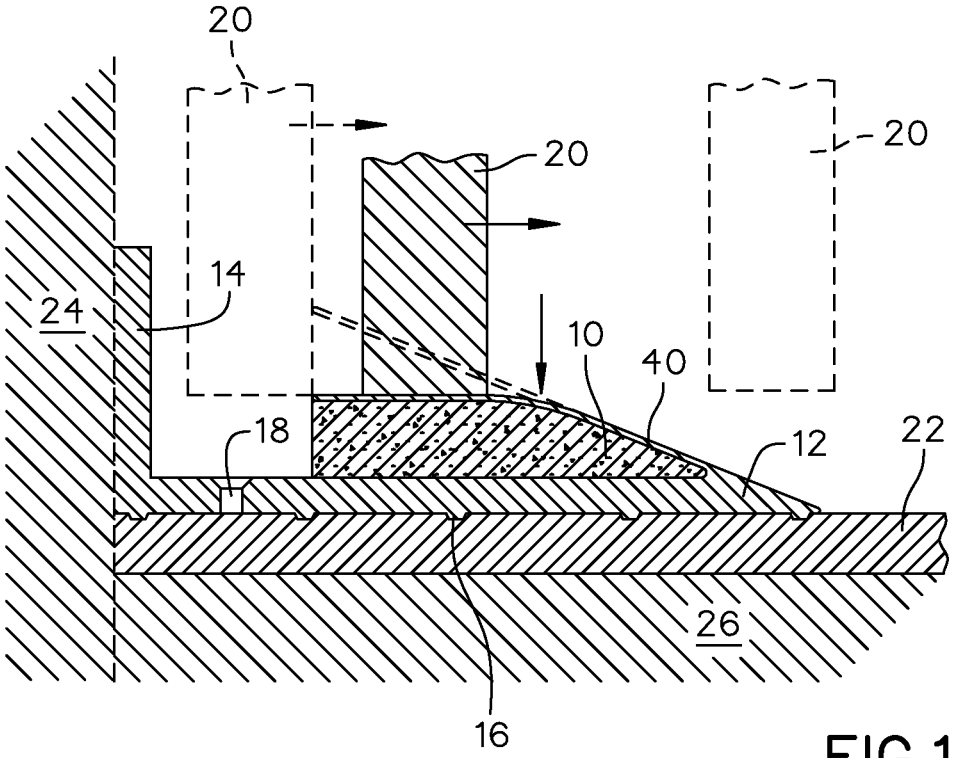
FIG. 14 depicts a side view of the alternative embodiment of the door wedge in use depicting the door being released from the wedge.

As depicted in FIG. 12, the door wedge is positioned against wall 24 and ground surface 26. It is understood that secondary ground surface 22 may exist between the door wedge and ground surface 26. Secondary ground surface 22 may be any type of floor surface known in the field such as a carpet. Door 20 slides over upper flexing tongue 40 until it is positioned in between vertical member 14, upper flexing tongue 40 and foam member 10. In this secured position, forward and backward movement of door 20 is prevented. FIG. 13 depicts door 20 in motion towards the secured position. FIG. 14 depicts door 20 in motion away from the secured position to release door 20 from the door wedge.

It shall be appreciated that the components of the door wedge described in several embodiments herein may comprise any alternative known materials in the field and be of any color, size and/or dimensions. This allows the door wedge to accommodate any variety and size of doors. It shall be appreciated that the components of the door wedge described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A door wedge for securing a door in a stationary position and comprising a locking mechanism configured to prevent forward and backward movement of the door, the door wedge comprising:

a base member comprising an upper layer and a lower layer configured to rest on a ground surface, the lower layer comprising a first end and a second end, wherein the second end is pivotably mounted to the upper layer; and a L-shaped member comprising a vertical member coupled to a horizontal member, wherein the horizontal member is slidably mounted to the first end of the lower layer, wherein the upper layer and lower layer of the base member are configured to compress with respect to each other to enable the door to slide over the upper layer and decompress to secure the door within space between the upper layer and the L-shaped member, thereby preventing forward and backward movement of the door; and, a slot disposed on the first end of the lower layer that extends through an interior portion of the lower layer, wherein the horizontal member of the L-shaped member is slidably mounted within the slot.

2. The door wedge of claim 1, further comprising a lip affixed to the L-shaped member, wherein the lip is configured to contact the ground surface and prevent the door wedge from tipping over when the door slides over the upper layer.

3. The door wedge of claim 1, further comprising a first nub affixed to a first side wall of the horizontal member and a second nub affixed to a second side wall of the horizontal member.

4. The door wedge of claim 3, further comprising a first set of grooves disposed on a first interior side wall of the slot and a second set of grooves disposed on a second interior side wall of the slot, wherein the first nub is configured to slidably engage with one of the grooves in the first set and the second nub is configured to slidably engage with one of the grooves in the second set, thereby locking the base member to the L-shaped member.

5. The door wedge of claim 4, further comprising teeth affixed to a bottom portion of the horizontal member and a bottom portion of the lower layer.

* * * * *